US005447357A

United States Patent [19]

Dauphin

[11] Patent Number: 5,447,357

[45] Date of Patent: Sep. 5, 1995

[54] CHAIR WITH INCLINABLE SEAT

[75] Inventor: Friedrich W. Dauphin, Offenhausen, Germany

[73] Assignee: Dauphin Entwicklungs- u. Beteiligungs-GmbH, Neukirchen, Germany

[21] Appl. No.: 109,432

[22] Filed: Aug. 20, 1993

[30] Foreign Application Priority Data

Aug. 21, 1992 [DE] Germany ..... 92 11 244.7 U

[51] Int. Cl.[6] ..... A47C 3/00

[52] U.S. Cl. ..... 297/301.4; 297/463.1

[58] Field of Search ..... 297/285, 291, 300–303, 297/313, 316, 340, 296, 297, 374, 327, 328, 362.13, 463.1

[56] References Cited

U.S. PATENT DOCUMENTS

| | | | |
|---|---|---|---|
| 3,656,593 | 4/1972 | Bauer . | |
| 3,711,054 | 1/1973 | Bauer . | |
| 4,200,332 | 4/1980 | Brauning . | |
| 4,521,053 | 6/1985 | de Boer | 297/291 X |
| 5,228,748 | 7/1993 | Neumuller | 297/374 |

FOREIGN PATENT DOCUMENTS

| | | | |
|---|---|---|---|
| 0105955 | 4/1984 | European Pat. Off. | 297/301 |
| 0179216 | 4/1986 | European Pat. Off. . | |
| 0281845 | 9/1988 | European Pat. Off. | 297/301 |
| 0394784 | 10/1990 | European Pat. Off. . | |
| 3030009 | 4/1982 | Germany . | |
| 856126 | 3/1986 | South Africa . | |
| 1597474 | 9/1977 | United Kingdom . | |

*Primary Examiner*—Kenneth J. Dorner
*Assistant Examiner*—Milton Nelson, Jr.
*Attorney, Agent, or Firm*—Browdy and Neimark

[57] ABSTRACT

A chair with inclinable seat, in particular an office chair, is provided with a pedestal, with a seat support supported on the pedestal via a chair column, which seat support comprises a front and a rear seat support element interconnected via a pivot axle, with a seat supported on the seat support elements, with a backrest secured to the rear seat support element and with a longitudinally adjustable energy storing device articulated to the seat support elements at a distance from their pivot axle for mutually adjusting the backrest and the seat. A support element is provided with a receptacle for the upper end of the chair column. The receptacle is articulated on the seat support element via an articulated axle arranged parallel to the pivot axle of the front and the rear seat support element. The seat support element is provided with a locking device effective between the seat support element and the receptacle for the purpose of locking or releasing, respectively, different inclinations of the seat support in relation to the chair column.

11 Claims, 4 Drawing Sheets

CHAIR WITH INCLINABLE SEAT

BACKGROUND OF THE INVENTION

1. Field of the Invention

The invention relates to a chair, in particular an office chair comprising a pedestal, seat support supported on the pedestal by means of a chair column, which seat support comprises a front seat support element and a rear seat support element interconnected via a pivot axle, a seat supported on the seat support elements, a backrest secured to the rear seat support element and a longitudinally adjustable energy storing device articulated to the seat support elements at a distance from their pivot axle for mutually adjusting the backrest and the seat, a front seat support element being provided with a receptacle for the upper end of the chair column.

2. Background Art

Chairs of this type are known from U.S. Pat. No. 4,200,332. Based on the interaction of the seat support elements, of the seat articulated to these seat support elements, of the backrest secured to the rear seat support element and of the gas spring placed between the seat support elements, chairs of this type have a so-called synchronous mechanism, in which any pivoting of the backrest is accompanied by a pivoting of the seat. Insofar in its inclined position the seat adapts in ergonomical manner to the pivoting position of the backrest in such a manner that when pivoting backwards the backrest by e.g. 10°, the rear portion of the seat inclines downwards by approximately 5° about the latter's front edge.

Basically, these known chairs have defined limit angles of inclination of the seat and the backrest, which can be adjusted in common owing to the synchronous mechanism. In this connection it is regarded to be disadvantageous that the seat and the backrest cannot be changed in inclination in particular in their extremely upright working position or in their extremely reclined relaxing position, respectively.

SUMMARY OF THE INVENTION

With the above considerations in mind it is the object of the invention to further improve a chair of the generic type in such a manner that the seat together with the backrest is additionally adjustable in inclination and arrestable in different positions of inclination regardless of the given adjustment of inclination owing to the synchronous mechanism, for the limit angles of inclination of the seat and the backrest defined by the synchronous mechanism to be variable within a range of adjustment.

This object is attained by a chair, wherein the receptacle is articulated on the front seat support element via an articulated axle arranged parallel to the pivot axle of the front and the rear seat support element and wherein the front seat support element is provided with a locking device effective between the front seat support element and the receptacle for the purpose of locking or releasing, respectively, the seat support in different positions of inclination relative to the chair column. Accordingly, one of the seat support elements is not directly and rigidly secured to the chair column, but is connected with the latter via an additional hinge. For arresting a certain basic inclined position proceeding from which the seat and the backrest are pivotable within certain bounds due to the synchronous mechanism, a lock of the seat with the aid of a locking device effective between the seat support and the bearing element is additionally provided. This permits an infinitely variable adjustment of inclination of the seat support element articulated to the chair column.

An advantageous embodiment of the invention relates to a chair, wherein the receptacle comprises a bearing element, on which the articulated axle is arranged. This permits the articulated axle to be fastened to the receptacle in constructionally favorable fashion.

According to a further embodiment of the invention the locking device is formed as a lamellar pack locking device. Lamellar structure locking devices of this type are principally known from the prior art—e.g. from EP 0 394 784 or DE 30 30 009 C2—for releasably locking two elements, pivotable towards each other, of seat support constructions.

In a chair, in which referred to the longitudinal direction of the seat the receptacle is arranged between the articulated axle and the locking device, the locking device is at a particularly great distance from the articulated axle, the action of the lever arm of the locking being considerable in relation to the articulated axle. Thus, with a given clamping force of the lamellar pack locking device, the locking effect is optimized.

Further embodiments of the invention characterize advantageous constructions of the lamellar pack locking device, of which the special merits are simplicity in design, compactness and ease-of-operation.

Even further preferred embodiments of the invention refer to advantageous constructions of the actuating mechanism of the lamellar pack locking device. In this case the locking device is released by a simple pivoting action of the actuating lever, which ensures operating facility.

BRIEF DESCRIPTION OF THE DRAWINGS

Further features, details and advantages of the invention will become apparent from the ensuing detailed description of an example of embodiment taken in conjunction with the drawing.

DESCRIPTION OF THE PREFERRED EMBODIMENT

Figure 1:
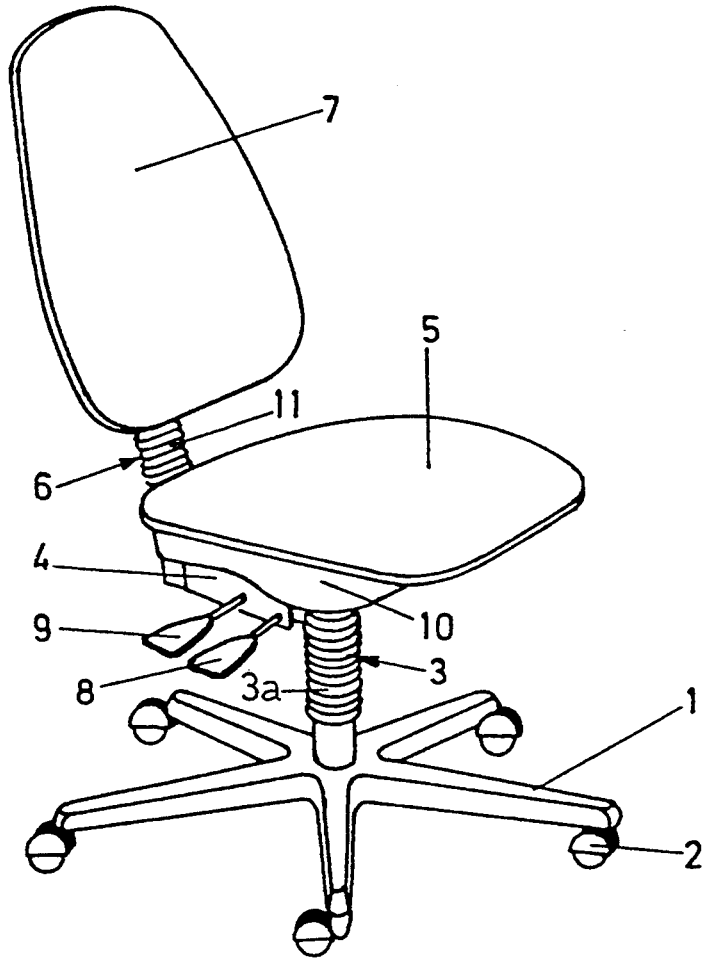
FIG. 1 is a perspective view of an office chair in accordance with the invention.

An office chair illustrated in FIG. 1 comprises a pedestal 1, supported via casters 2 on the ground. A chair column 3 adjustable in height and surrounded by bellows 3*a* is attached to the pedestal 1. To the upper end of the chair column 3 a seat support 4 is detachably secured, on which in turn an upholstered seat 5 is disposed. A backrest support 6, which extends substantially upwards and to the upper end of which a backrest 7 is secured, is arranged on the seat support 4. The height adjustment of the chair column 3 is performed by means of an operating lever 8. For the purpose of changing the inclination of the backrest 7 with backrest support 6 while simultaneously changing the inclination of the seat 5, a further actuating lever 9 is supported on the seat support 4. The seat support 4 may be partially or substantially covered optically by a casing 10 arranged on the bottom side of the seat 5. As can be seen from FIG. 1, the backrest support 6 is coated by bellows 11 for optical reasons.

The described basic construction of the office chair is generally known. The chair column 3 adjustable in height is known for instance from U.S. Pat. No. 3,711,054 or from U.S. Pat. No. 3,656,593, respectively. The construction of the seat support 4 including the described pivoting possibility of backrest 7 and seat 5 is known for instance from ZA-Patent 85/6126.

Figure 2:
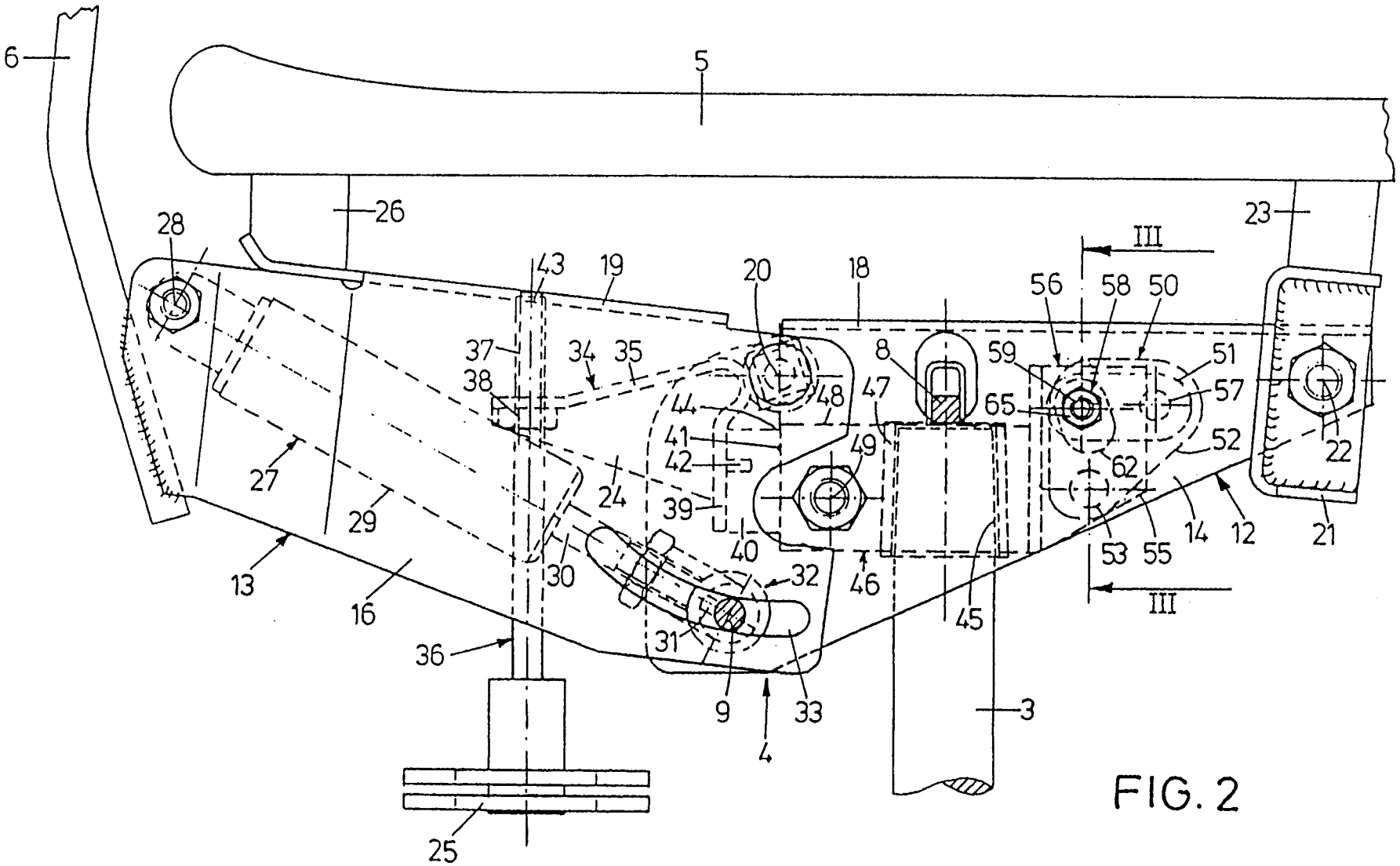
FIG. 2 is a side view of the seat element base construction.
Figure 3:
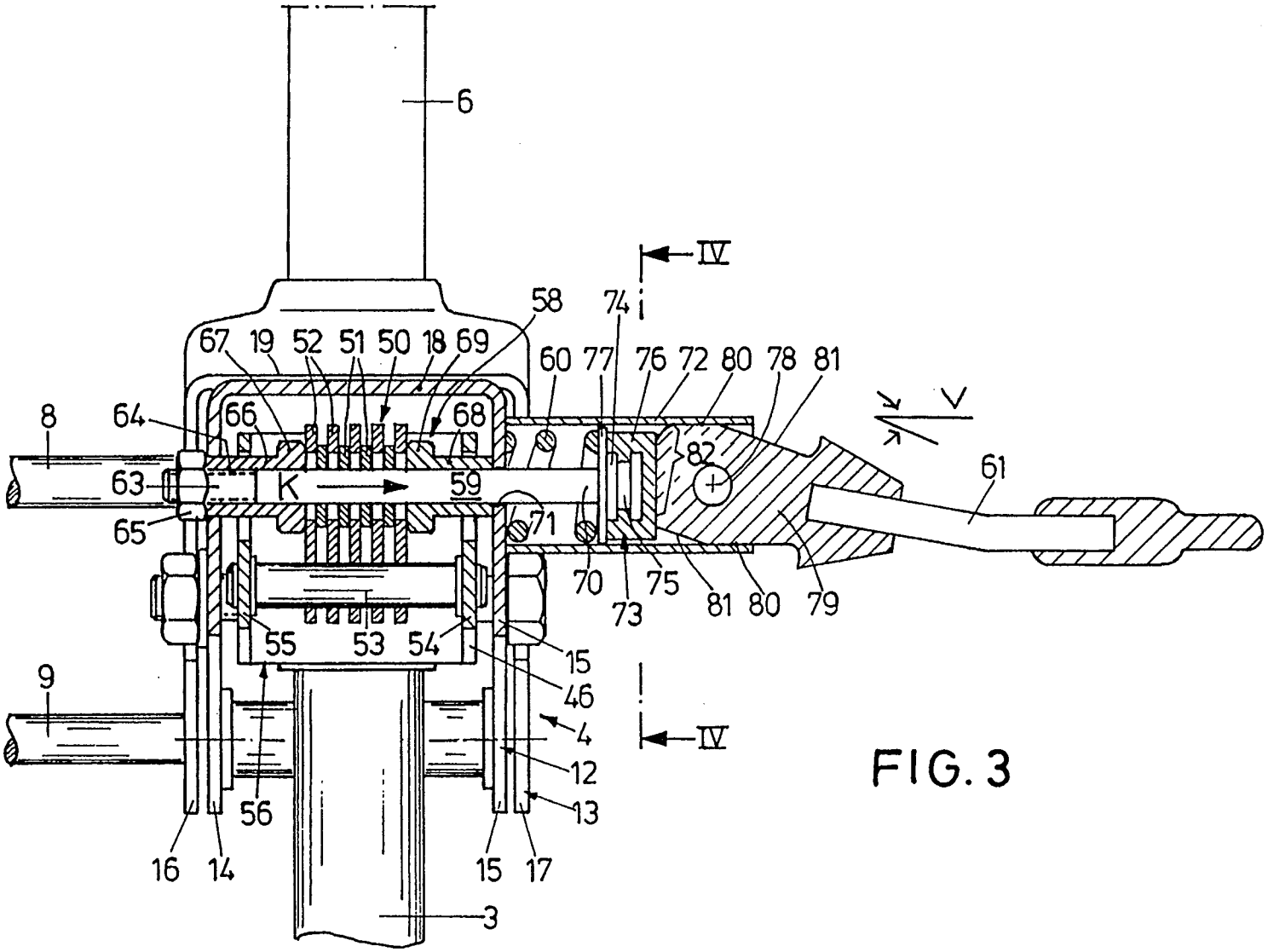
FIG. 3 is a cross-sectional view of the base construction along the line III—III according to FIG. 2

As can be seen from FIGS. 2 and 3, the seat support 4 is divided. It consists of a front seat support element 12 and a rear seat support element 13, which have a substantially U-shaped cross-section which is open downwards. This results in that they comprise two side walls 14, 15 or 16, 17, respectively, which are interconnected by bottoms 18 or 19, respectively, facing the seat 5. The two seat support elements 12, 13 are interconnected by a pivot axle 20 arranged adjacent to their bottoms 18, 19.

On the front end of the seat support 4 a seat holder 21 is arranged to be pivotable about a pivot axle 22, the seat holder 21 being formed by a profile extending at right angles to the main plane of symmetry of the chair, i.e. at right angles to the plane of the drawing of FIG. 2. On this seat holder 21 the seat 5 is supported via spacers 23.

The seat 5 is furthermore supported on and secured to the bottom 19 of the rear seat support element 13 by means of elastic buffers 26.

On the rear end of the rear seat support element 13, i.e. in the region where the backrest support 6 is secured to the rear seat support element 13, a longitudinally adjustable energy storing device in the form of a longitudinally adjustable gas spring 27 is articulated about a pivot axle 28, which extends parallel to the pivot axles 20 and 22. The housing 29 of the gas spring 27 faces this pivot axle 28, a piston rod 30 being extracted from the other end of the gas spring 27. An actuating pin 31, by means of which a valve located in the gas spring can be actuated for length adjustment, protrudes from the piston rod 30. By means of a thread the piston rod 30 is connected with an actuating device 32 comprising the actuating lever 9. This actuating device 32 is supported between the side walls 14, 15 of the front seat support element 12 to be pivotable parallel to the pivot axles 20, 22, 28. The actuating lever 9 is guided through and out of an oblong hole 33 in the associated side wall 16 of the rear seat support element 13, this oblong hole being curved in such a manner, that its center coincides with the pivot axle. Any length adjustment of the gas spring 27 will result in the front seat support element 12 and the rear seat support element 13 being pivoted relative to each other about the pivot axle 20, which on the one hand causes the inclination of the seat 5 to be changed and on the other hand the backrest support 6 with the backrest 7 to be pivoted simultaneously. Devices of this type are designated as so-called synchronous mechanisms. If the actuating pin 31 is pushed into the piston rod 30 of the gas spring 27 not just for a short time in order to achieve a change of length of the gas spring 27 and thus a change of the position of the seat 5 and the backrest 7, but if the actuating pin 31 is pushed into the piston rod 30 for a prolonged time, then the seat 5 together with the backrest 7 can be tilted.

The construction of the seat support 4 with the seat 5—as far as it has been hitherto described—is known from ZA-Patent 85/6126. The construction and arrangement of the actuating device 32 and of the gas spring 27 are known from European non-examined published patent application 0 179 216.

A spring abutment 34 of angle-lever-type cross-sectional design is supported to be pivotable about the pivot axle 20 of the front and rear seat support element 12 or 13, respectively. An abutment lever 35 extends from the pivot axle 20 backwards, i.e. in the direction towards the backrest support 6, and that below the bottom 19 of the rear seat support element 13.

By means of its external thread 37 an adjusting screw 36 is arranged in an internal thread 38 on the abutment lever 35 in the vicinity of the latter's free end. The threads 37, 38 are self-locking. The free end of the adjusting screw 36 supports itself against the bottom 19 of the rear seat support element 13.

The other abutment lever 39 extending vertically in relation to the lever 35 downwards from the pivot axle 20 bears against a spring 40 formed by a block of elastic material, for example a neoprene foam. The other end of this spring abuts against a stationary, however pivotable abutment 41, which is formed by a rear wall, located opposite the lever 39, of the bearing element 46, which is described in detail below. The spring 40 is secured to a pin-like projection 42 of the lever 39, so that it cannot fall out downwardly from the region between the lever 39 and the abutment 41.

Neoprene is the usual designation, which is not protected by a trademark, for chloroprene, a chlorinated hydrocarbon.

If—as is shown in FIG. 2—the external thread 37 of the adjusting screw 36 is completely screwed through the internal thread 38 of the spring abutment 34, the abutment lever 39 is in its position next to the abutment 41, i.e. the spring 40 is biased most strongly. Once again it is emphasized that the abutment 41 is arranged within the front seat support element 12.

If, with the gas spring 27 unlocked, the backrest 6 is pivoted backwards, the portions located below the pivot axle 20 of the front and the rear seat support elements 12 or 13, respectively, are pivoted towards each other, i.e. the spring is pressed more strongly together while this backward pivoting movement of the backrest 7 is progressively damped. This counterforce of the spring 40 thus progressively opposes the pivoting backward of the backrest 7. When the backrest 7 is relieved, its pivoting forward is assisted by a corresponding release of the spring 40, this assisting force diminishing while the backrest 7 pivots forward.

If the adjusting screw 36 is screwed downwardly out of the abutment lever 35 so far that its front end 43 is approximately flush with the lever 35, the spring 40 cannot be effective during the entire possible range of pivoting of the front and the rear seat support element 12, 13, i.e. it is not pressed together between the abutment 41 and the abutment lever 39 while producing a corresponding counterforce.

In any intermediate positions of the adjusting screw 36, the spring 40 is engaged in case of correspondingly different pivoting positions of the rear seat support element 13 in relation to the front seat support element 12, i.e. in case of different backward inclinations of the backrest 7 and thus of the seat 5. In addition, in these intermediate positions, at first only an edge 44 of the block-like spring 40 rests on the abutment 41, which contact steadily increases with a further pivoting movement for full face rest on the abutment 41. This gives also rise to the fact that a certain progression in the spring action is achieved.

For the purpose of the spring abutment 34 per se being resistant to bending, the levers 35, 39 are reinforced by one or more intermediate webs 24. In order to prevent the adjusting screw 36 from being inadvertently screwed out of the internal thread 38, its external thread is pinched in usual manner in the vicinity of its end 43. In order to permit an easy operation of the adjusting screw 36 it is provided with a twist handle 25 on its end protruding downwardly out of the seat support 4. The adjusting screw 36 is staggered in relation to the gas spring 27. The gas springs 27 are commercially available and are generally known with regard to construction and mode of operation for instance from U.S. Pat. No. 3,656,593.

For the additional adjustment of inclination of the entire seat 5 with the synchronous mechanism, the front seat support element 12 is articulated to the upper end, forming a bearing cone 45, of the chair column 3 via a bearing element as a whole referred to as 46. The bearing element 46 is seated with an inner-cone-shaped bearing block 47 on the bearing cone 45 of the chair column 3. The bearing block 47 is fastened in a longitudinally oriented rectangular tube 48, which on its side located downstream of the bearing block 47, supports an articulated axle 49 in the form of a simple screw with nut extending parallel to the pivot axle 20. The front seat support element 12 is articulated to this articulated axle 49.

For the purpose of locking the seat 5 in a determined inclined position the front seat support element 12 is provided with a lamellar pack locking device, which is effective between the front seat support element 12 and the bearing element 46, and which is arranged in front of the bearing block 47. It comprises a lamellar pack 50 fastened to the bearing element 46 and consisting of lamellas 52, which are arranged parallel to each other with frictional resistance elements 51 being positioned between them. The lamellas 52 are approximately triangular in the side view (outlined by a dash line in FIG. 2), their corner portion directing downwards being seated on an axle 53 on the bearing element 46, which axle 53 is held between the two lateral cheeks 54, 55 of a U-shaped profiled element 56 which is open towards the front, of the bearing element 46. The frictional resistance elements 51 of elongated oval shape in the side view are fixed in the lamellar pack 50 by a further retaining bolt 57, which loosely holds together the frictional resistance elements 51 and the lamellas 52.

The lamellar pack locking device further comprises a releasable clamping device 58, arranged on the front seat support element 12 and consisting of a clamping bolt 59, a helical compression spring 60 and an actuating lever 61. The clamping bolt 59 penetrates with play the lamellar pack 50 in a direction transversal to the lamellas 52 and is arranged on the front seat support element 12 to be longitudinally axially displaceable in this transversal direction. The clamping bolt 59 drives with its first end 63 the lamellar packe 50 via a nut 65 sitting on a thread 64 and via a driving sleeve 66 provided with a flange 67 for locking the lamellar pack 50 in the clamping direction K. For this purpose the clamping bolt 59 is subject to spring loading action generated by compression spring 60 in the clamping direction K and is displaceable counter to the clamping direction K by means of the actuating lever 61 for releasing the locking.

Figure 4:
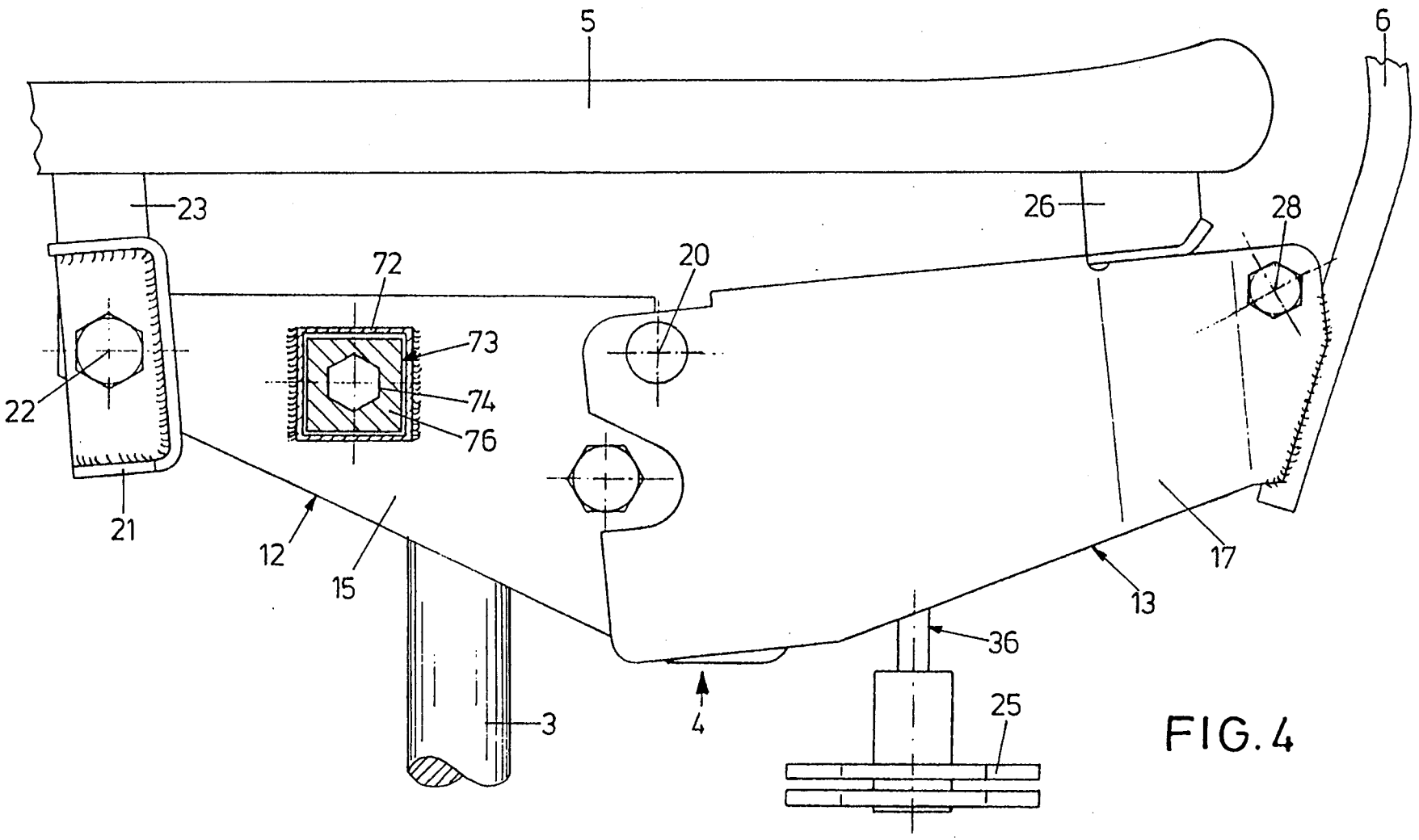
FIG. 4 is a section through the base construction along the line IV—IV according to FIG. 3.

Furthermore, between the side wall 15, facing away from the end 63, of the front seat support element 12 and the lamellas 52 an abutment sleeve 68 is arranged on the clamping bolt 59, which sleeve 68 comprises an abutment flange 69 on its end on the lamella side. With its opposite end the abutment sleeve 68 bears against the side wall 15. The second end 70 of the clamping bolt 59 is guided out of the front seat support element 12 via a bore 71 in the latter's side wall 15 and ends within a guide tube 72 formed as a rectangular tube, which is arranged on the external side of the side wall 15 coaxially with the clamping bolt 59 (FIG. 4). The extracted end 70 of the clamping bolt 59 is provided with an approximately cuboid actuating head 73, which is formed of an internal hexagon 74 having a circumferential groove 75 and of a cover 76 molded thereon.

The helical compression spring 60, which actuates the clamping bolt 59 in the clamping direction K is placed between the external side of the side wall 15 of the front seat support element 12 and the actuating head 73, a shim 77 being positioned therebetween.

Externally in front of the actuating head 73 of the clamping bolt 59, the actuating lever 61 is supported on the free end of the guide tube 72 to be pivotable about a pivot axle 78 extending at right angles to the clamping direction K. The actuating lever 61 contacts the actuating head 73 via a cam-like swivel bearing element 79. This swivel bearing element 79 comprises stop faces 80, 81 for limiting the pivot angle, which are arranged within the guide tube 72 and which on the sides, facing away from each other, of the swivel bearing element 79, form obtuse-angled wedge surfaces for limiting the pivot angle V of the actuating lever 61. The cam region 82, formed by a plane and convex element, of the swivel bearing element 79 is provided on the side, facing the actuating head 73, of the swivel bearing element 79.

FIG. 3 shows the lamellar pack locking device in its locked condition. Owing to the driving action of the helical compression spring 60, the clamping bolt 59 clamps the lamellar pack 50 in relation to the abutment sleeve 68 via the driving sleeve 66, there being no possibility of any movement of the clamping bolt 59 and thus of the front seat support element 12 connected with the latter relative to the lamellar pack 50 and thus again relative to the bearing element 46 rigidly connected with the latter. Thus the seat 5 is locked in the shown inclined position.

For the purpose of releasing the locking, the actuating lever 61 is pivoted counterclockwise as referred to FIG. 3, which causes the clamping bolt 59 to be displaced counter to the clamping direction K and the driving actuation by the helical compression spring 60 by means of the eccentric, convex cam region 82 of the swivel bearing element 79. This causes the clamping grip around the lamellar pack 50 to be released, as a result of which the clamping bolt 59 and thus the entire seat support 4 together with the backrest support 6 can be moved in relation to the lamellar pack 50 and to the bearing element 46 within the bounds defined by the oblong holes 62, which leads to the inclination of the seat 5 and the backrest 7 to be adjusted in common by the same angular amount. By restoring the actuating lever 61 to the position shown in FIG. 3 the lamellar pack locking device is transformed into its locked condition.

What is claimed is:

1. A chair, in particular an office chair, comprising a pedestal (1), a seat support (4) supported on the pedestal (1) by means of a chair column (3), which seat support (4) comprises a front seat support element (12) and a rear seat support element (13) interconnected via a pivot (20), a seat (5) supported on the seat support elements (12, 13), a backrest (7) secured to the rear seat support element (13) and a longitudinally adjustable energy storing device (27) articulated to the seat support elements (12, 13) at a distance from their pivot axle (20) for mutually adjusting the backrest (7) and the seat (5), the front seat support element (12) being provided with a receptacle (47) for the upper end of the chair column (3), wherein the receptacle (47) is articulated on the front seat support element (12) via an articulated axle (49) arranged parallel to the pivot axle (20) of the front and the rear seat support elements (12, 13) and wherein the front seat support element (12) is provided with a locking device effective between the front seat support element (12) and the receptacle (47) for the purpose of locking and releasing, respectively the seat support (4) in different positions of inclination relative to the chair column (3).

2. A chair according to claim 1, wherein the receptacle (47) comprises a bearing element (46), on which the articulated axle (49) is arranged.

3. A chair according to claim 2, wherein the receptacle (47) is arranged between the articulated axis (49) and the locking device.

4. A chair according to claim 1, wherein the locking device is a lamellar pack locking device (50).

5. A chair according to claim 3, wherein the receptacle (47) comprises a bearing element (46), on which the articulated axle (49) is arranged and wherein the lamellar pack locking device comprises a lamellar pack (50) secured to the bearing element (46), which lamellar pack (50) consists of lamellas (52) arranged parallel to each other with frictional resistance elements (51) being positioned between them, as well as a releasable clamping device (58), arranged on the front seat support element (12), for the lamellar pack (50), which clamping device (58) together with the seat support (4) is displaceable in its released condition relative to the lamellar pack (50) for the purpose of an adjustment of inclination.

6. A chair according to claim 5, wherein the clamping device (58) comprises a clamping bolt (59) penetrating with play the lamellar pack (50) in the transverse direction to its lamellas (52), and guided on the seat support element (12) to be longitudinally axially displaceable in this transverse direction, which clamping bolt (59) drives with a first end (63) the lamellar pack (50) for its locking in the clamping direction (K) and for this purpose is subject to spring loading action (60) in the clamping direction (K), the clamping bolt (59) being displaceable counter to the clamping direction (K) by means of an actuating lever (61) for releasing the locking.

7. A chair according to claim 6, wherein the bearing element (46) with the lamellar pack (50) is arranged within the front seat support element (12), the clamping bolt (59) with a second end (70) facing away from the lamellar pack (50) being extended out of the front seat support element (12) and being guided in a guide tube (72) secured to the front seat support element (12), in which guide tube (72) a compression spring (60) is arranged for spring-loading the clamping bolt (59) and on which guide tube (72) the actuating lever (61) is supported.

8. A chair according to claim 7, wherein said second end (70) of the clamping bolt (59) is provided with an actuating head (73), the compression spring (60) supporting itself between the actuating head (73) and an external side of the front seat support element (12).

9. A chair according to claim 7, wherein the clamping bolt (59) is provided with a driving element (66) on its first end (63) driving the lamellar pack (50) and with an abutment element (68) in a central region between the lamellar pack (50) and an internal side of a wall (15) of said front seat support element (12) adjacent to the guide tube (72), via which abutment element (68) the lamellar pack (50) supports itself on this internal side in its locked condition.

10. A chair according to claim 7, wherein the actuating lever (61) is supported on a free end of the guide tube (72) to be pivotable about a pivot axle (78) extending at right angles to the clamping direction (K) and contacts said second end (70) of the clamping bolt (59) via a swivel bearing element (79) comprising a cam region (82) in such manner that the clamping bolt (59) is displaceable counter to the clamping direction (K) by a pivoting movement of the actuating lever (61).

11. A chair according to claim 10, wherein the swivel bearing element (79) comprises stop face (80, 81) arranged within the guide tube (72) for limiting the pivot angle (V) of the actuating lever (61).

* * * * *